US005890551A

United States Patent [19]

Liljebrand et al.

[11] Patent Number: 5,890,551

[45] Date of Patent: Apr. 6, 1999

[54] ROCK DRILLING TOOL INCLUDING A DRILL BIT HAVING A RECESS IN A FRONT SURFACE THEREOF

[75] Inventors: Per-Olof Liljebrand, Sandviken; Orban Olsson, Forsbacka, both of Sweden

[73] Assignee: Sandvik AB, Sandviken, Sweden

[21] Appl. No.: 812,730

[22] Filed: Mar. 6, 1997

[30] Foreign Application Priority Data

Mar. 14, 1996 [SE] Sweden ..... 9600983

[51] Int. Cl.[6] ..... E21B 10/36

[52] U.S. Cl. ..... 175/418; 175/414

[58] Field of Search ..... 175/414, 415, 175/417, 418, 420.1, 420.2, 393, 405

[56] References Cited

U.S. PATENT DOCUMENTS

| | | | |
|---|---|---|---|
| 3,322,218 | 5/1967 | Hildebrandt . | |
| 3,388,756 | 6/1968 | Varel et al. . | |
| 3,583,504 | 6/1971 | Aalund . | |
| 4,323,130 | 4/1982 | Dennis | 175/393 |
| 4,527,642 | 7/1985 | Knowlton et al. | 175/393 |
| 4,598,779 | 7/1986 | Liljekvist et al. | 175/415 |
| 4,730,682 | 3/1988 | Ditzig . | |
| 4,776,411 | 10/1988 | Jones . | |
| 4,869,330 | 9/1989 | Tibbitts . | |
| 5,435,402 | 7/1995 | Ziegenfuss | 175/414 |

FOREIGN PATENT DOCUMENTS

| | | | |
|---|---|---|---|
| 254229 | 2/1988 | Dominican Rep. | 175/414 |
| 1227799 | 4/1986 | U.S.S.R. | 175/418 |
| 2242464 | 10/1991 | United Kingdom | 175/420.1 |

OTHER PUBLICATIONS

"RAMBLAST Percussion Bits"; a brochure from Hughes Tool Division. Jul. 1991.

*Primary Examiner*—Hoang C. Dang
*Attorney, Agent, or Firm*—Burns, Doane, Swecker & Mathis, L.L.P.

[57] ABSTRACT

A drill bit for percussive drilling includes a front surface in which cutting inserts are mounted. A recess is formed in the front surface, and a fluid channel extends through the drill bit for supplying flushing fluid to the recess. The recess is completely bordered by an endless land. Some of the cutting inserts are mounted in the land. Others of the cutting inserts are mounted in the recess in order to be cooled and flushed by a cushion of flushing fluid created in the recess.

13 Claims, 2 Drawing Sheets

ROCK DRILLING TOOL INCLUDING A DRILL BIT HAVING A RECESS IN A FRONT SURFACE THEREOF

BACKGROUND OF THE INVENTION

This invention relates to a rock drill bit and tool for percussive drilling. The bit includes a head portion having a front surface in which a number of cutting inserts are mounted. The inserts include outer inserts arranged in an annular row, and a number of front inserts placed radially inside that row. A first portion of the front surface is recessed in relation to a surrounding second surface portion. At least one channel for feeding flush medium to cool inserts and convey away drill cuttings terminates in the recessed portion of the front surface.

PRIOR ART

Disclosed for example in SE 359,350, U.S. Pat. No. 3,388,756 and CA 1 300 124 are previously known drill bits whose front surface has a recessed space supplied with flushing fluid by a flush medium channel. The recessed space communicates with the peripheral (i.e., radially outer) part of the head portion via a groove which is substantially as deep as the recess itself. The object of this groove is primarily to guarantee an efficient feed of flush medium to the ring-shaped space between the head portion and the surrounding bore wall for the major purpose of guaranteeing quick and efficient removal of drill cuttings. However, the ability of the evacuation grooves to enable quick drainage of the flush medium in a direction towards the cylindrical outer surface of the head portion, results in poor cooling of the front inserts, especially the central front inserts. Research related to the present invention has shown that substandard cooling of the front inserts constitutes a decisive cause of development of so called reptile skin on inserts. Such a reptile skin consists of a pattern of micro cracks which successively develops in the cemented carbide containing inserts, due to great variations between the highest and lowest temperatures in connection with the intermittent impact movements. In practice, rock drill bits of the discussed type are operated with a impact frequency of for example 50 Hz (3,000 impacts/minute) and a speed of rotation of for example 80 revolutions/minute. Even if the pressure of the flush medium is comparatively high (for example 8 bar for water) the cooling effect becomes deficient, specifically when the individual insert accomplishes an impact; the temperature rises by leaps in that instant. The problems with high temperatures is particularly pronounced in connection with drilling in ore containing rock, i.e., magnetite for example. If the reptile skin formed by micro cracks is not removed through grinding within fairly short intervals (for example after 100 m of drilling), the micro cracks will develop into deep cracks which may relatively soon result in individual insert breakage. This can lead to breakage of the entire drill bit.

With the purpose of improving cooling and cleaning of inserts on rotary drill bits U.S. Pat. No. 4,776,411 has proposed to develop a number of endless land portions on the front surface of the drill bit. Each land portion frames and wholly surrounds a respective recessed space in which a channel for feed of flush medium terminates. When the flush medium is supplied through these channels, a cushion of flush medium is formed in each recessed space. However all front inserts on the drill bit are provided on the land portions; none are in the recessed spaces. This means that the cooling effect of the flush medium is improved only in a limited fashion, because all inserts, including the central inserts, are distant from the flush medium cushions.

Similar drill bits for rotary drilling are described in U.S. Pat. No. 3,322,218 and EP 0 325 271.

OBJECTS AND FEATURES OF THE INVENTION

The present invention aims to eliminate the above mentioned drawbacks of earlier known rock drill bits and to create an improved drill bit for percussive drilling. A primary object of the invention is thus to create a drill bit and a rock drilling tool, the front inserts of which are cooled in a more efficient manner than corresponding inserts on earlier known drill bits in order to counteract the development of reptile skin on the inserts, all for the primary purpose of increasing the life-span of the drill bit and the rock drilling tool. It is also an object to create a drill bit and a rock drilling tool, which in spite of improved cooling ability and increased tool life, retains constructive simplicity in such a manner that it does not result in substantial increases in manufacturing costs.

According to the invention, a rock drill bit for percussive drilling comprises a head portion which includes a front surface having an outer surface portion and an inner surface portion disposed radially inside of the outer surface portion. The inner surface portion is recessed with respect to the outer surface portion to form a recess which is surrounded by an endless land. A front face of the land forms the outer surface portion of the front surface. A fluid channel extends through the head portion and communicates with the recess for conducting a flushing medium thereto. A plurality of peripheral cutting inserts is mounted in the front surface portion at a location radially outside of the recess. The peripheral inserts are arranged generally annularly around a longitudinal axis of the drill bit. A plurality of front inserts is mounted in the front surface at a location radially inside of the peripheral inserts. At least one of the front inserts is disposed in the inner surface portion and projects forwardly therefrom by a distance greater than a longitudinal depth of the recess.

The present invention also relates to a rock drilling tool which utilizes the above-described drill bit.

DETAILED DESCRIPTION OF A PREFERRED EMBODIMENT OF THE INVENTION

Figure 1:
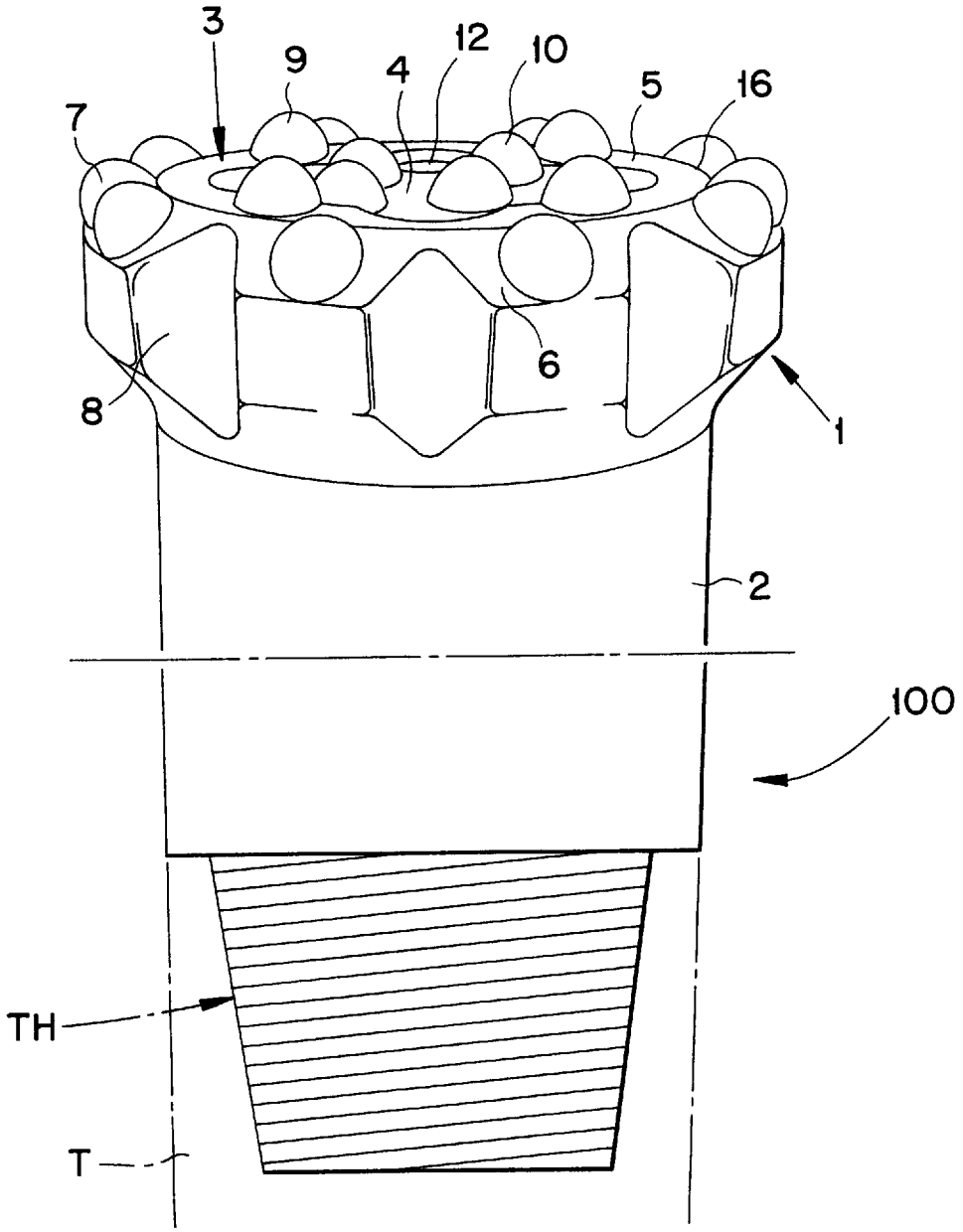
FIG. 1 shows a partial perspective view illustrating a drill bit and tube of a drilling tube according to the present invention.

In the drawings a rock drill bit is shown, which in a usual manner comprises a substantially cylindrical head portion 1 and a more slender shaft 2. The head portion 1 comprises a front surface or a front side designated with 3, in which a number of inserts are mounted. More precisely the front surface includes a first (or inner) surface portion 4 which is recessed to a certain depth in relation to a surrounding second (or outer) surface portion 5. A third surface portion 6, located between the surface portion 5 and the periphery of the head portion, is conically shaped. On this conical surface 6 are provided a number of first inserts 7 forming a peripheral ring on the head portion. As is distinctly evident from FIG. 2 for example, the inserts 7 in this case project somewhat outside the periphery of the head portion in order to machine a hole during drilling which has a somewhat bigger diameter than the very head portion. Recesses 8 are provided in areas between adjacent peripheral inserts 7, through which flush medium can pass. A number of front inserts are provided also in the area located inside the peripheral inserts 7, which depending on their position, are designated by numerals 9 and 10, respectively. The rock drill bit is coupled to a drill tube T in a drill string by means of a threaded connection TH. The tube includes a channel for conveying fluid. When assembled, the rock drill bit 1 and the drill tube T constitute a rock drilling tool 100.

Figure 3:
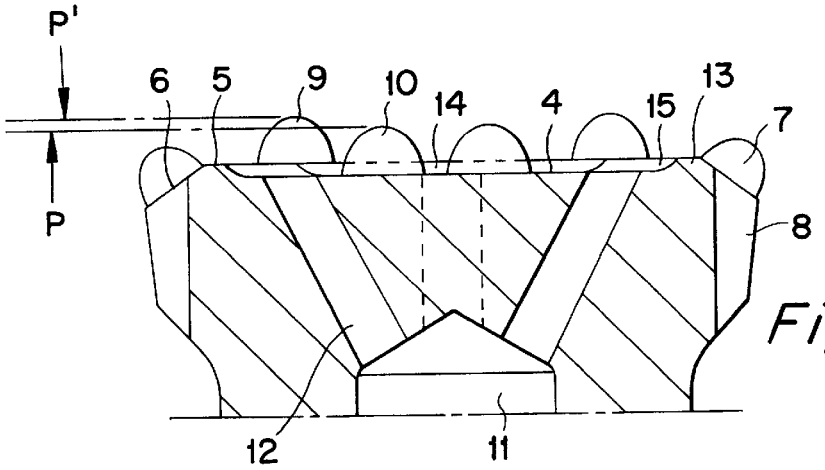
FIG. 3 shows a section taken along line A—A in FIG. 2.
Figure 4:
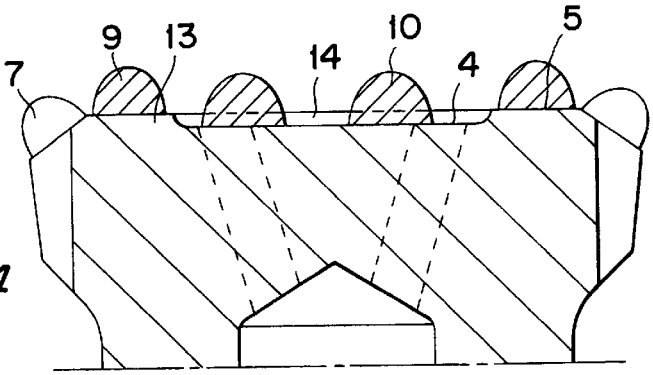
FIG. 4 shows a section taken along line B—B in FIG. 2.

As evident from FIGS. 3 and 4, a main channel 11 for flush medium is provided inside the drill bit. This main channel communicates at its forward end with a number of branch channels 12, which terminate in the first, recessed surface portion 4. In this connection It may be noted that one or more flush medium channels also can terminate in said recesses 8. The flush medium will in practice comprises water or air.

The second surface portion 5 constitutes a part of an endless land portion or material portion 13 which in the example is substantially circularly ring-shaped. By being endless and ring-shaped, this land portion 13 completely surrounds the recessed space 14 whose bottom is formed by the first surface portion 4. In other words, the land portion 13 forms a circumferential edging which borders the mainly cylindrical, although shallow space 14, the bottom of which space is formed by the first surface portion 4. In the shown embodiment both surface portions 4, 5 are substantially planar and mutually parallel. The surface portions extend essentially perpendicularly to the longitudinal central axis of the drill bit. Since having the land portion 13 is endless, i.e. it lacks disruptions in the form of radial evacuation grooves, the flush medium that is fed out through channels 12 will form a cushion or pool, which is retained by the endless land portion.

The four front inserts which are designated by numeral 9, are secured in the ring-shaped, planar surface portion 5. In the example these front inserts are spaced equi-distantly. The remaining four front inserts which are designated by numeral 10, are secured in the recessed surface portion or bottom 4, in an irregular pattern. As evident from FIGS. 3 and 4 these front inserts 10 project farther from the surface portion 4 than the depth with which this surface 4 is recessed in relation to the surrounding, ring-shaped surface portion 5. In the shown example the front inserts 10 have a height relative to the surface portion 5 which is substantially equal to the height of the front inserts 9 relative to the surface portion 5. This means that the inserts 10 project to a common planar level P which is spaced from that of the common planar level P' of the front inserts 9. In other words the central front inserts 10 are somewhat longitudinally recessed in relation to the surrounding, more peripheral front inserts 9.

In practice all inserts advantageously are made of cemented carbide. The shape of the inserts may vary considerably. They can thus be spherical, conical, ballistic or semi-ballistic.

Figure 2:
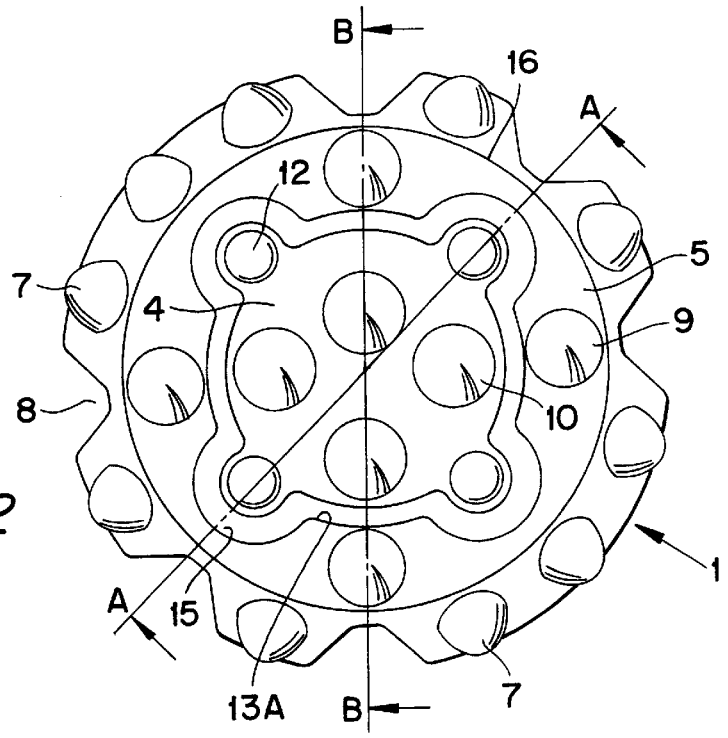
FIG. 2 shows a front end view of a head portion according to FIG. 1.

As is evident from FIG. 2 a number of radially recessed spaces 15 is formed in a radially inner wall 13A of the endless, ring-shaped land portion 13, which wall 13A forms a side of the recess 14. The spaces 15 intersect the surface portion 5. More exactly, four equi-distantly separated spaces 15 are provided in the land portion. Each individual space 15 is substantially semicircular. An individual branch channel 12 for flush medium terminates at least partially in the planar bottom of each such space 15 which bottom is defined by the surface portion 4. It may also be noted that each individual space 15 is located about midway between two adjacent outer front inserts 9. The cushion of flush medium which is formed in the space 14 will thus continuously be supplied with flush medium via four equidistantly separate channels. That guarantees an even discharge of flush medium to all parts of the space 14.

In practice, the area of the first, recessed surface portion 4 can amount to 30–65%, more preferably 40–55% of the total area of the planar surface which exists inside a circular edge 16 defined by the intersection of surface portion 5 and the conical surface 6. In other words the space 14 occupies a relatively large part of the entire front surface. The depth of the space 14 relative to the surface portion 5 may vary within fairly wide limits, for example in the area of 1–7 mm for drill bits with ordinary diameters. In the shown example, where the drill bit has an operative outer diameter of about 100 mm, the depth of the pool-like space 14 amounts to about 2.5 mm. In connection therewith, the height of the inserts 9, 10 can be in the range of 6–12, more preferably 8–10 mm. (Note: the height of each insert 9 is measured from the surface 5, and the height of each insert 10 is measured from the surface 4.)

Since the endless, ring-shaped land portion 13 guarantees the formation of a continuous, maintained cushion of flush medium, water for example, in the space 14, the centrally positioned front inserts 10 will be flushed in a versatile and intensive manner with flush medium, ensuring efficient cooling of the inserts in all operational phases of the drill bit, i.e. during each part of an individual impact movement as well as during each part of a return movement. Each impact will further immerse the front inserts with flush medium. Since the endless land portion 13 lacks deep evacuation grooves, the flush medium will flow away from the cushion in an essentially evenly distributed radially directed flow from the recessed space 14 to the ring-shaped space between the bore wall and the surface of the head portion. More exactly, the flush medium will flow evenly across the planar surface portion 5 of the land portion. This means that also inserts 7 and 9 are subjected to an essentially evenly distributed cooling.

Modifications of the Invention

The present invention is not limited to the described embodiment and the associated drawings. The front surface of the head portion can include two or more recessed spaces 14. Furthermore the surface portions 4, 5 need not necessarily be planar. For example, the surface portion 4 can have a somewhat dome-shaped form in the recessed space 14. Furthermore, the surrounding surface portion 5 can have a structure which differs from the smooth planar shape. For example, the surface portion 5 can be rough. An essential feature of the present invention is that the endless land portion 13 does not have any deep grooves which allow concentrated evacuation of flush medium.

Although the present invention has been described in connection with preferred embodiments thereof, it will be appreciated by those skilled in the art that additions, deletions, modifications, and substitutions not specifically described may be made without departing from the spirit and scope of the invention as defined in the appended claims.

What is claimed:

1. A rock drill bit adapted for percussive drilling, the drill bit comprising:

a head portion defining a longitudinal center axis, the head portion including a front surface having an outer surface portion, and an inner surface portion disposed radially inside of the outer surface portion, the inner surface portion being recessed with respect to the outer surface portion to form a recess surrounded by an endless land, a front face of the land forming the outer surface portion;

a fluid channel extending through the head portion and communicating with the recess for conducting a flushing medium thereto;

peripheral cutting inserts mounted in the head portion radially outside of the outer surface portion and arranged generally annularly around a longitudinal axis of the drill bit; and front cutting inserts mounted in the front surface radially inside of the peripheral inserts, a first plurality of the front inserts being disposed in the inner surface portion, and a second plurality of the front inserts being disposed in the outer surface portion, the inserts of the first plurality being spaced at varying radial distances from the center axis, all of the inserts of the first plurality projecting forwardly from the inner surface portion by a distance greater than a longitudinal depth of the recess.

2. The drill bit according to claim 1 wherein the first plurality of inserts extending forwardly beyond the outer surface portion by a distance which is less than a distance by which the second plurality of inserts projects forwardly beyond the outer surface portion.

3. The drill bit according to claim 2 wherein the at least one flushing channel intersects the inner surface portion; the land including a radially inner wall forming a side of the recess, the wall including a radially recessed space, the intersection between the flushing channel and the inner surface portion lying in the radially recessed space.

4. The drill bit according to claim 1 wherein the inner and outer surface portions are substantially planar and parallel to one another, the inner and outer surface portions extending substantially perpendicular to the longitudinal axis.

5. The drill bit according to claim 1 wherein an area of the inner surface portion formed 30 to 65% of an area of the front surface.

6. The drill bit according to claim 1 wherein an area of the inner surface portion constitutes 40 to 55% of an area of the front surface.

7. A rock drilling tool adapted for percussive drilling comprising a drill bit and drill tube threadedly interconnected, the drill bit comprising:

a head portion defining a longitudinal center axis, the head portion including a front surface having an outer surface portion and an inner surface portion disposed radially inside of the outer surface portion, the inner surface portion being recessed with respect to the outer surface portion to form a recess surrounded by an endless land, a front face of the land forming the outer surface portion;

a fluid channel extending through the head portion and communicating with the recess for conducting a flushing medium thereto;

peripheral cutting inserts mounted in the head portion radially outside of the outer surface portion and arranged generally annularly around a longitudinal axis of the drill bit; and front cutting inserts mounted in the front surface radially inside of the peripheral inserts, a first plurality of the front inserts being disposed in the inner surface portion, and a second plurality of the front inserts being disposed in the outer surface portion, the inserts of the first plurality being spaced at varying radial distances from the center axis, all of the inserts of the first plurality projecting forwardly from the inner surface portion by a distance greater than a longitudinal depth of the recess.

8. The rock drilling tool according to claim 7 wherein the first plurality of inserts extending forwardly beyond the outer surface portion by a distance which is less than a distance by which the second plurality of inserts projects forwardly beyond the outer surface portion.

9. The rock drilling tool according to claim 7 wherein the at least one flushing channel intersects the inner surface portion; the land including a radially inner wall forming a side of the recess, the wall including a radially recessed space, the intersection between the flushing channel and the inner surface portion lying in the radially recessed space.

10. The rock drilling tool according to claim 9 wherein there are four, substantially equi-distantly spaced radially recessed spaces formed in the wall, the radially recessed spaces being in communication with respective fluid channels.

11. A rock drill bit adapted for percussive drilling, the drill bit comprising:

a head portion including a front surface having an outer surface portion, and an inner surface portion disposed radially inside of the outer surface portion, the inner surface portion being recessed with respect to the outer surface portion to form a recess surrounded by an endless land, a front face of the land forming the outer surface portion;

a fluid channel extending through the head portion and communicating with the recess for conducting a flushing medium thereto;

a plurality of peripheral cutting inserts mounted in the front surface portion radially outside of the recess and arranged generally annularly around a longitudinal axis of the drill bit; and a plurality of front inserts mounted in the front surface radially inside of the peripheral inserts, at least one of the front inserts being disposed in the inner surface portion and projecting forwardly therefrom by a distance greater than a longitudinal depth of the recess;

a first plurality of the front inserts being disposed in the inner surface portion, and a second plurality of the front inserts being disposed in the outer surface portion, the first plurality of inserts extending forwardly beyond the outer surface portion by a distance which is less than a distance by which the second plurality of inserts projects forwardly beyond the outer surface portion;

the at least one flushing channel intersecting the inner surface portion;

the land including a radially inner wall forming a side of the recess, the wall including a radially recessed space, the intersection between the flushing channel and the inner surface portion lying in the radially recessed space.

12. The drill bit according to claim 11 wherein there are four, substantially equi-distantly spaced radially recessed spaces formed in the wall, the radially recessed spaces being in communication with respective fluid channels.

13. A rock drill bit adapted for percussive drilling, the drill bit comprising:

a head portion including a front surface having an outer surface portion, and an inner surface portion disposed radially inside of the outer surface portion, the inner surface portion being recessed with respect to the outer surface portion to form a recess surrounded by an endless land, a front face of the land forming the outer surface portion;

a fluid channel extending through the head portion and communicating with the recess for conducting a flushing medium thereto;

a plurality of peripheral cutting inserts mounted in the front surface portion radially outside of the recess and arranged generally annularly around a longitudinal axis of the drill bit; and a plurality of front inserts mounted in the front surface radially inside of the peripheral inserts, at least one of the front inserts being disposed in the inner surface portion and projecting forwardly therefrom by a distance greater than a longitudinal depth of the recess;

wherein the inner and outer surface portions are substantially planar and parallel to one another, the inner and outer surface portions extending substantially perpendicular to the longitudinal axis.

* * * * *